US006201196B1

(12) United States Patent
Wergen

(10) Patent No.: US 6,201,196 B1
(45) Date of Patent: Mar. 13, 2001

(54) JOYSTICK ASSEMBLY

(76) Inventor: Gerhard Wergen, Parkstrasse 1, D-90513 Zirndorf (DE)

( * ) Notice: Subject to any disclaimer, the term of this patent is extended or adjusted under 35 U.S.C. 154(b) by 0 days.

(21) Appl. No.: 08/945,916

(22) PCT Filed: May 30, 1996

(86) PCT No.: PCT/EP96/02332

§ 371 Date: May 22, 1998

§ 102(e) Date: May 22, 1998

(87) PCT Pub. No.: WO96/38810

PCT Pub. Date: Dec. 5, 1996

(30) Foreign Application Priority Data

| | | |
|---|---|---|
| Jun. 2, 1995 | (DE) | 195 19 941 |
| Sep. 25, 1995 | (DE) | 295 15 312 U |
| Nov. 19, 1995 | (DE) | 295 18 293 U |

(51) Int. Cl.[7] ..... H01H 25/00; G09G 5/08

(52) U.S. Cl. ..... 200/6 A; 345/161

(58) Field of Search ..... 200/6 A; 345/161; 414/4, 694; 341/20, 31–34; 74/471

(56) References Cited

U.S. PATENT DOCUMENTS

| | | | | |
|---|---|---|---|---|
| 2,841,659 | * | 7/1958 | Eitel | 200/6 A |
| 3,238,316 | * | 3/1966 | Voss | 200/6 A |
| 3,293,381 | * | 12/1966 | Eitel | 200/6 A |
| 3,360,620 | * | 12/1967 | Ward | 200/6 A |
| 3,835,270 | * | 9/1974 | Dufresne | 200/6 A X |
| 4,414,438 | * | 11/1983 | Maier et al. | 200/6 A |
| 4,470,320 | * | 9/1984 | Kim | 200/6 A X |
| 5,831,596 | * | 11/1998 | Marshall et al. | 345/161 |

FOREIGN PATENT DOCUMENTS

| | | | |
|---|---|---|---|
| 151479 | * | 8/1985 | (EP) . |
| 0151479A3 | | 8/1985 | (EP) . |
| 0616298A1 | | 9/1994 | (EP) . |
| 616298 | * | 9/1994 | (EP) . |
| 2211280 | * | 6/1989 | (GB) . |
| WO 93-20535 | * | 10/1993 | (WO) . |

* cited by examiner

*Primary Examiner*—J. R. Scott
(74) *Attorney, Agent, or Firm*—Wood, Herron & Evans, L.L.P.

(57) ABSTRACT

A single-axis or multi-axis joystick assembly which is operative with a minimal amount of input force or displacement. As such, the joystick assembly is especially suited for those with severe motor handicaps who have limited movement in their extremities. The joystick assembly includes a housing and a handle operatively mounted to the housing for movement relative thereto. The handle operatively engages a sensor which generates an output signal when an input force is applied to the handle. The output signal is proportional to the input force. Preferably, the sensor is a piezoelectric pressure transducer.

20 Claims, 3 Drawing Sheets

JOYSTICK ASSEMBLY

FIELD OF THE INVENTION

The present invention generally relates to a joystick assembly.

BACKGROUND OF THE INVENTION

A joystick can be used in a variety of applications. For instance, a joystick may be used as a computer input device or as a mouse replacement; as a control stick for controlling the movements of mobile or stationary equipment, such as self-propelled wheelchairs for the handicapped, excavators and robots; as a slide for mixing board potentiometers; for parameter modification in machine control; and for manual entry of variable scale magnitudes. These known uses for joysticks share the common property that the greater the manually effected deflection, the greater the resulting change in the variables will be; the more rapidly the deflection must be performed, the more rapidly the variable should change. For the handicapped, who must act with the muscles in the remaining stump of an amputated extremity to control a prosthesis or a vehicle, such joysticks are difficult to operate, if at all, because the radius of action within which these persons can still exert a controlled muscle force no longer covers the stroke of such displacement-dependent joysticks. Finally, the large stroke input also requires a large amount of space for the construction and operation of these joysticks. This deficiency exists not only with potentiometer entries, but generally for displacement sensors for the generation of analog control signals, for example, in pivot lever systems for linear displacements with internal kinematic conversion. In addition, lever systems in joysticks often have the disadvantage of nonlinear reactions to the input stroke, which complicates some control tasks. Joysticks with bending elements with wire resistance strain gauges according to GB 2,211,280 A or EP 0,151,479 A or with Hall elements according to WO 93/20535 A as sensors have similar disadvantages. If the manually executed stroke is limited, the resolution, and thus the precision and reproducibility of the setting, is reduced. Moreover, such joysticks which are actuated by displacement inputs present, from a manufacturing standpoint, a solution which is quite expensive and sensitive to mechanical interference, such as, sensitivity to impact or shock. Although the latter drawback does not strictly apply to key pairs, for example, the buttons or remote volume controls of a radio receiver, the precise fine tuning of a nearly achieved specified valve is complicated even for keys reacting at two speeds, and thus is imprecise in practice.

SUMMARY OF INVENTION

The present invention provides a robust single-axis or multi-axis joystick which can be encapsulated to protect against contamination, yet remain easily accessible and resistant to impact. With this joystick, a person can enter values with great accuracy, reproducibility and dynamic response, all without becoming fatigued over a long time. Advantageously, the rest position (e.g., the null position) should be particularly easy to find from any position, and in addition implementation of the joystick should be cost effective, because it is very simple, compact and reliable.

The present invention is primarily a single-axis or multi-axis joystick, which can receive inputs from a user with virtually no displacement of an input handle. As such, the joystick can be used in a fatigue-free manner, with minimal use of force, so that persons with extremely severe motor impairment can use it. The core of this solution is a mechanically stable, simply designed but precise suspension of a one- or two-arm lever, preferably tared to a neutral equilibrium, which rests almost without clearance against sensors which are engageable with virtually no displacement of the lever. The lever includes a handle extending out of a sealed housing. The handle is pivotable about an axis to receive manual inputs transverse to the pivot axis. In contrast to known displacement-dependent joysticks, the joystick of the present invention operates practically without mechanical deflection and without free play. Advantageously, the pressure input direction is not unintentionally lost, as in the case of movement along a freely specifiable path in a two-axis system. This has a particularly positive effect on the control of cursor movement, for example, during CAD entry. Displacement-free joysticks can also be cascaded for very precise two-axis entry because their handles can be arranged one inside the other with low radial clearance.

The pressure exerted on the sensor can also be integrated by signal-processing technology as long as the pressure remains present, and for the case of a known pressure dependence of the physical sensor behavior, thus permits the implementation of pressure measurement tasks and also force measurement tasks in the case of pressure application to a constant surface area. Thus, the swing of the output signal, e.g., the path length of a linear cursor movement or the end position of a digital display device, is dependent on the duration of the pressure input, and the dynamic response of the signal, e.g., the speed of the movement of a cursor on the display screen or the rate of change of the digital display device, is dependent on the intensity of the pressure currently being manually applied, with practically no displacement, to the handle.

Therefore, this joystick is particularly well suited for industrial use under rough environmental conditions, for those handicapped who have limited bodily movement, and for surgeons to control motorized aids during surgery.

Although in the context of the present invention, the housing of the joystick is mounted rigidly with the handle projecting therefrom to receive inputs, it is within the purview of this invention that the handle be mounted rigidly and the actuation forces be inputted through a manually accessible housing.

DETAILED DESCRIPTION OF PREFERRED EMBODIMENTS

Figure 5:
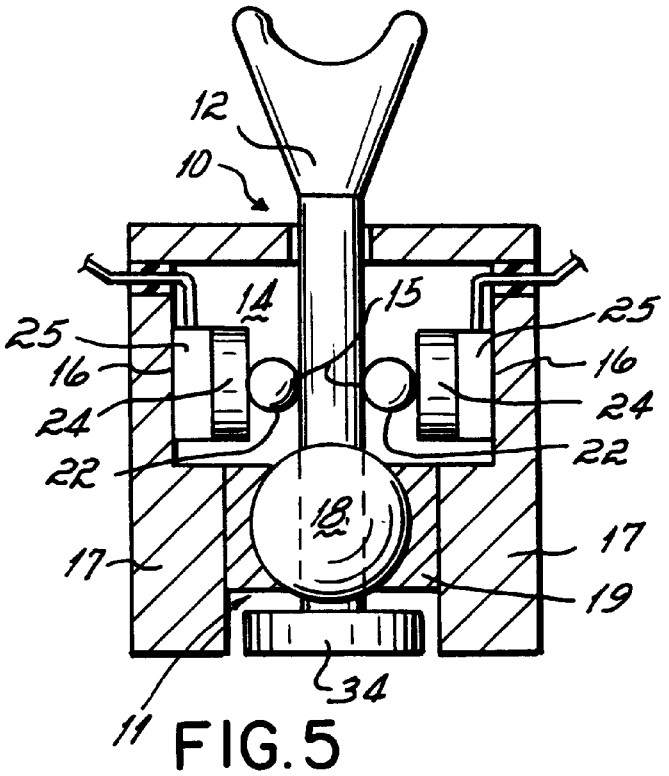
FIG. 5 shows a joystick with sensor force application according to FIG. 1, but with a one-arm handle lever.
Figure 6:
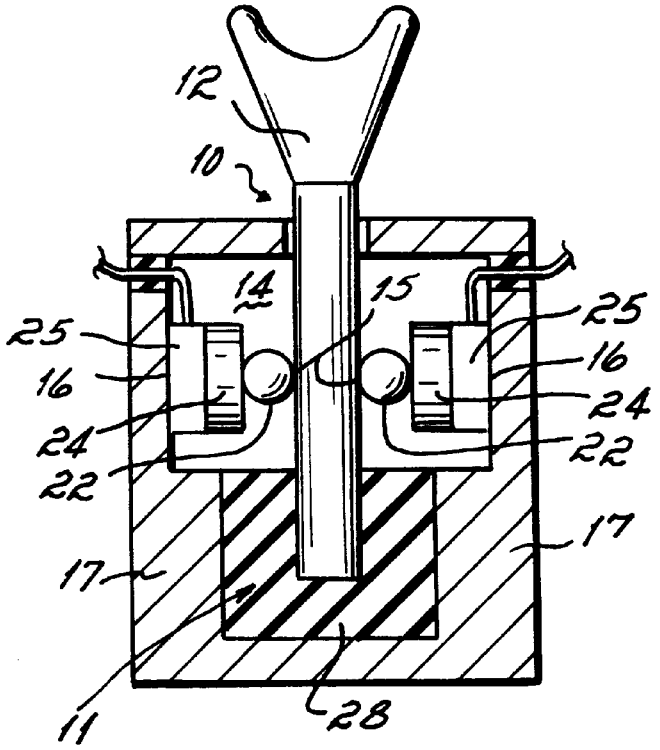
FIG. 6 shows a joystick according to FIG. 5 but with an elastic axial bracing instead of a roller bearing suspension of its handle.

At an opening 10, a linear rod-shaped handle 12 is held by a form-fitting suspension 11 and extends outwardly from housing 14 in each illustrated embodiment. Although only minimally pivotable under transverse force input, the handle 12 is suspended from the housing 14 in an articulad manner, specifically by means of a ball joint 18 (FIGS. 1 and 3–5), by means of a roller joint 29 (FIG. 2) or by means of a resilient block 28 (FIG. 6), and, more specifically, suspended directly or indirectly between lateral housing walls 17 (FIGS. 4, 5, 6), from a housing cover wall 16 (FIGS. 1, 2, 3, 4).

In applications requiring less precision, the geometrically defined joints 19 and 29, which are axially rigid with respect to the handle 12, can be replaced by rubber mounts, which are bonded, for example, by vulcanization, on all sides to the handle 12 and the housing 14.

Although the handle 12 and pressure element 15 are subject to minimal displacement during force input, it has been found that using geometrically defined spherical or roller bearing of the joints 19, 29 yields more precision and less static friction. Because static friction is minimized, the control element has higher sensitivity and reproducibility during the application of pressure to the sensors 25. By using this type of suspension 11, it is possible, for example, to guarantee a response sensitivity of 200 mN for a rod having a diameter of 30 mm for the handle 12.

Because the form-fitting suspension 11 provides a rigid structure for handle 12 and pressure element 15, sensors 25 are insensitive to axial mechanical stresses on the handle 12; thus the electrical output, which alone determines the control function based on the manually applied transverse pressure, is not influenced by axially applied stresses. In rough machine operations or in fatiguing design work, the operator can grip the projecting handle 12 with his/her fist, and rest the fist on the housing cover plate 16, without causing an excitation of the sensors 25, before the fist causes a lateral application of force to the handle 12. Because axial pressure components and tensile forces are absorbed by the precision bearing of suspension 11 in stable housing 14, they do not cause a displacement of the pressure element 15 which subsequently applies force to the sensors 25.

The convex profiled piece of the ball joint 18 can be attached to the handle 12 or molded directly to its outer surface, so that it projects radially outwardly from the handle 12. The convex profiled piece rests in a dish 19 with a hollow spherical portion which may be, for example, secured to the housing 14, or molded directly as a part of the housing 14. In the case of an undivided double dish 19, its central hole can be enlarged or expanded by temporary heating, in order to accommodate the spherical profiled piece 18 in the form of a bearing. It is also possible to design the dish 19 as a part of the housing with resilient elements in the upper half, to achieve simpler manufacturing and assembly. The seal of housing 14 with rigid suspension 11 about the fixed point of rotation relative to the axial direction of handle 12 is the essential reason for the high reproducibility and response sensitivity of the pressure application to the sensors 25, with the possibility to adjust the external force input requirements depending on the lever arm ratio with respect to the joint 18 or 29 (particularly compared to the corresponding properties, for example, of an unstable toe bearing at the lower end of a swivelling lever handle against the bottom of the housing; or a handle which is braced at the lower end with a swivelling plate for irregular axial pressure application to a group of sensors as described in EP 0,616, 298 A).

Figure 1:
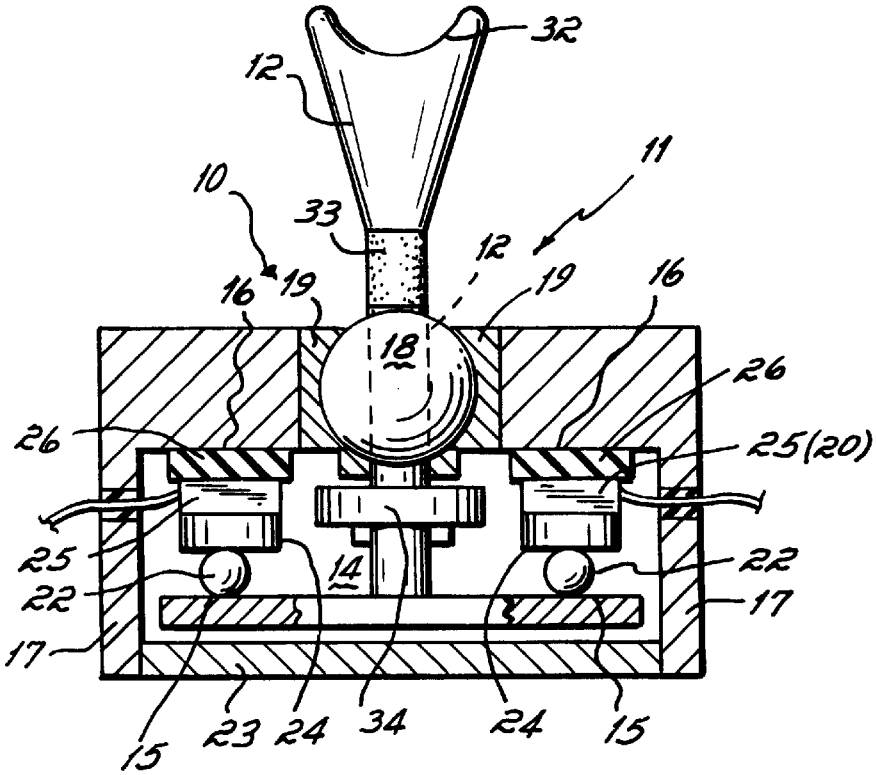
FIG. 1 represents a joystick assembly according to the invention with a two-arm lever and with two sensors parallel to the housing axis.
Figure 2:
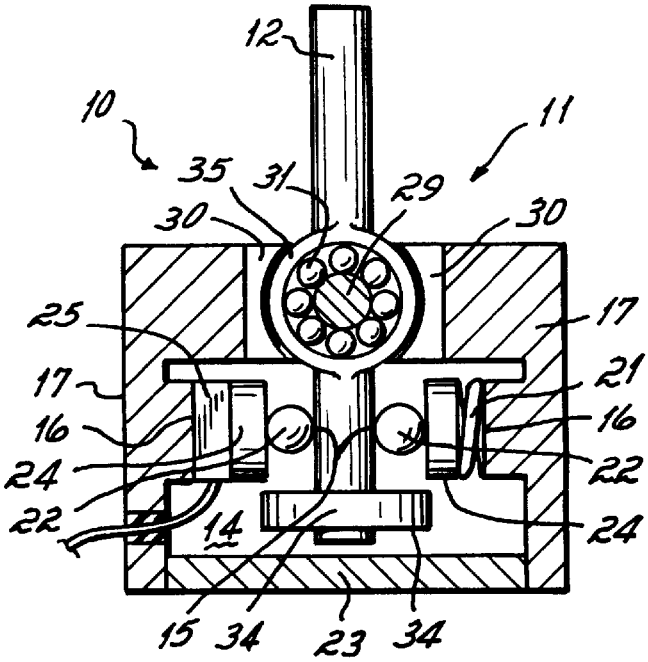
FIG. 2 shows a joystick assembly similar to that of FIG. 1, but with a roller bearing in its handle and with two sensors disposed radially with respect to the housing.

The ratios for a uniaxial or roller joint bearing 29 of the lever consisting of handle 12 and pressure element 15 (FIG. 5) are correspondingly advantageous if the handle 12 with its pressure element 15 is supported in housing 14 by a stationary shaft with the insertion of a sliding, spherical or other bearing 31 inside ring 35 of handle 12 (FIG. 2). The ring 35 is preferably surrounded by a profiled part 30 in the shape of a hollow cylinder, approximately in the adjacent wall of the housing 14, which again results in a good sealing of the interior of the housing 14 in which the sensors 25 are arranged.

Figure 3:
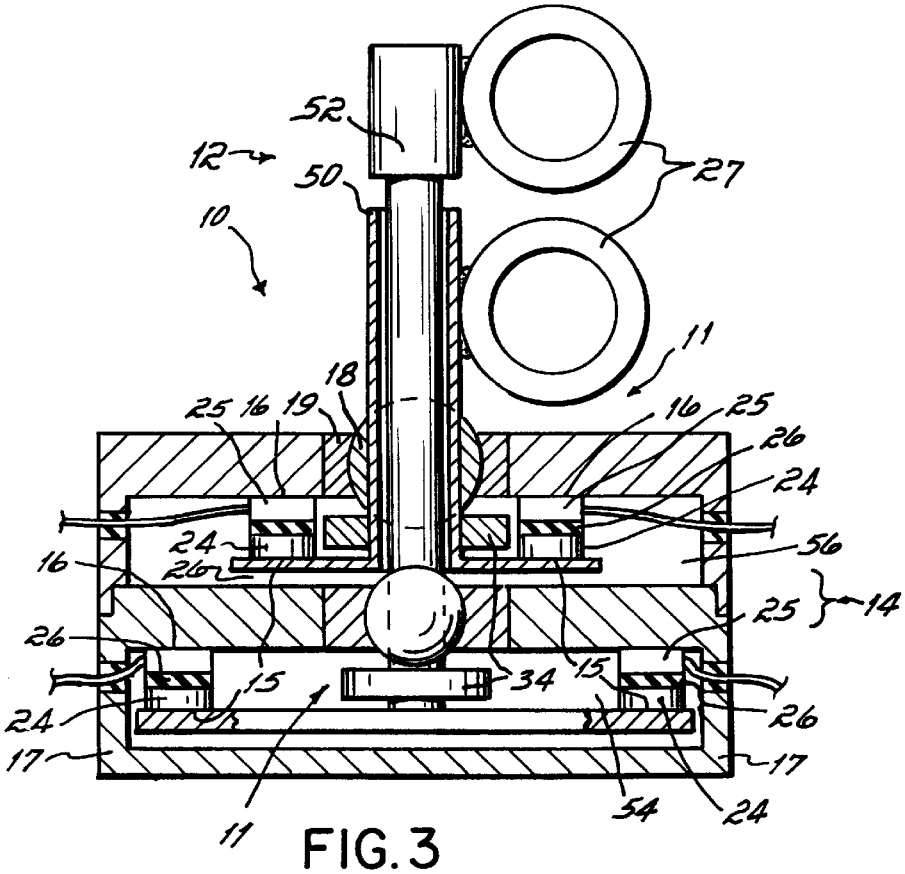
FIG. 3 represents two coaxial cascading joysticks according to those of FIG. 1.
Figure 4:
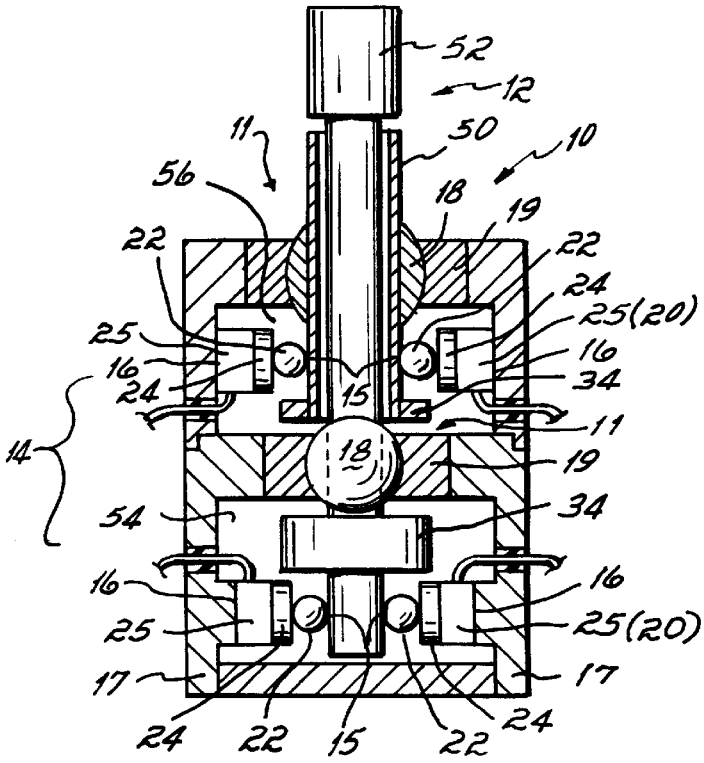
FIG. 4 shows a joystick cascade according to FIG. 3 with sensor arrangement according to FIG. 2.

For this roller joint 29 (FIG. 2), the movement of lever 12 is restricted to pivotal motion about the axis of roller joint 29. However, in the ball joint 18 (FIGS. 1 and 3–5) and in the resilient block 28 (FIG. 6), it is possible, in principle, to apply transverse pressure in any direction with respect to the housing 14 onto the handle 12, which extends from the housing 14, for example, terminating with a finger groove 32 (FIGS. 1, 5, 6), or equipped with a finger ring 27 (FIG. 3). Accordingly, depending on the arrangement of force sensors 25 in the housing 14, preferably only in two mutually orthogonal directions (FIGS. 1 and 3–6), into which a pressure force which is acting laterally on the handle 12 is decomposed according to a force parallelogram. If no protection is provided for over rotation for ball joint holder 18, then one can change the direction of the applied pressure about the longitudinal axis of handle 12, and still maintain a constant resultant of the force parallelogram. This facilitates the control of the cursor during CAD input. To effect rotation of the transverse force into the handle 12, it is necessary to equip the free end of the handle 12 with a rigid cap or dish (not shown) which can easily be gripped by the finger tips. However, should this rotation of the handle 12 be undesirable, a type of Cardan suspension consisting of two orthogonal roller bearings can be implemented for the two-dimensionally acting handle 12.

In the housing 14, pressure elements 15 are rigidly affixed to handle 12 for the transmission of force to the sensors 25. The handle 12 and its pressure element 15, depending on the relative position of bearing joints 18, 28, 29, together form a two-armed (FIGS. 1–4) or a one-armed (FIGS. 5, 6) lever. The two-armed lever is preferably tared to neutral equilibrium by means of a longitudinally adjustable counterweight 34 (FIGS. 1–5) so that pivoting resulting from transverse pressure to the handle 12 (which in any case is quite minimal) can be introduced with greater sensitivity, and thus position-dependent pressure influences on the sensors 25 can be avoided as much as possible.

For a one-armed lever, the taring weight 34 lies outside the actual lever area between the handle 12 and the pressure-transferring element 15 for the sensors 25, on the other side of joint 18 (FIG. 5) or 29. As such, the opening 10 would have to be sealed in addition, for example, by means of a bellows sleeve. One advantage of the one-armed lever is the short axial length of the system. That is, the one-armed lever provides a compactly constructed tared freely-moving, displacement-free joystick.

In both cases, it is possible to specify a response pressure upon application of an input pressure to the handle 12, by means of lever ratios, by means of elasticity constants (see below) and prestresses applied to the support bodies 26, and finally by the response sensitivity of the sensors 25. The instant applied pressure to the sensors 25, individually or paired in a differential connection, can be queried by a signal-processing unit inside or outside of the housing 14. In this embodiment, a signal swing conversion can occur as function of the duration or intensity of the instant transverse pressure application on the handle 12.

The lever consisting of handle 12 and pressure element 15 extends from opening 10 between the lateral walls 17 of the tubular housing, preferably rectangular in cross section. inside housing 14, pressure elements 15 are always parallel to, but not contacting, sensors 25. However, under certain mechanical prestress, the pressure elements 15 are parallel (FIGS. 1 and 3) or transverse (FIGS. 2, 4–6) with respect to the axial direction of the handle 12 and contact the sensors 25, where the sensors are mounted to the housing 14. Each sensor 25 may be, for example, a semiconductor, a piezoelectric transducer, a magnetostrictive or light fiber element, or any other analog pressure sensor which is operable without displacement.

By inserting rigid disk 24 of defined surface area between the pressure element 15 and the sensor 25, the manually transmitted pressure is converted according to the lever ratio into a force. The disk 24 simultaneously equalizes the pressure acting over the sensor surface area, which is of practical importance, for example, for the characteristic curve profile in polymer film pressure sensors.

An equalization of the pressure transfer onto the individual sensors 25, while maintaining contact with the pressure transmitting element 15, is achieved by inserting slightly elastic deformable support bodies 26 behind (FIG. 1) or in front of (FIG. 3) the sensors 25. As such, the chance of mechanically overloading the sensors 25 is eliminated. At the same time these deformable bodies 26 effect, like elastic intermediary piece 33 between the handle 12 and pressure element 15 (FIG. 1), a measurable deflection when pressure is applied to the handle 12. In certain applications, particularly in rough machine operation, it may be desirable to require increased manual intervention to effect an input. However, in accordance with principles of the present invention, it is not displacement but rather force which is the input variable. Although this control element is operable without displacement, the elastic intermediary piece 33 must not be too soft.

In order to apply pressure with higher precision and reproducibility despite minimal pivoting of the pressure element 15, the pressure is applied perpendicularly onto the sensor 25 or onto a separately applied disk 24 by means of a spherical intermediate member 22. Spherical member 22 can be formed at the disk 24 or at the pressure element 15 as a knob. If spherical member 22 concentrically surrounds pressure element 15 as a molded-on ring, then any overrotation will not effect the actual pressure applied to the sensor 25.

A pair of sensors 25 is provided diametrically opposing one another with reference to the axis of the handle 12 for each control axis of the control element. In this configuration, differential evaluation serves to, for example, linearize the effective response characteristic curve, define the quiescent point or eliminate influences not directly opposite each other, such as from thermal expansion effects or mechanical acceleration influences.

To reduce costs, only one sensor 25 is needed per axis; the second sensor may be a dummy 20 which is not connected to the data collection unit. The second sensor may also be an elastic bracing body (26) or a separate rigid spring 21 (FIG. 2). Each sensor 25 per axis, which is now the only one acquired by the data collection unit, is thus prestressed by its counterpart which is at a resting position, in order to increase or to decrease its internal pressure depending on the direction of the manual transverse force applied to the handle 12.

Since the handle 12 undergoes nearly no deflection during the application of force, the handle 12 may have an outer member 50 and an inner member 52 (FIGS. 3 and 4), which are pivotally suspended to respective upper and lower portions 54, 56 of housing 14. These outer and inner members 50, 52 can operate four axes simultaneously with one hand, for example. Inner member 52 is coaxially aligned with outer member 50 with some radial clearance therebetween. For both outer and inner members 50, 52, the same lever ratios are maintained on both sides of their ball joints 19 from the suspension 11, so that both outer and inner members 50, 52 can be operated with the same characteristic sensitivity. Preferably, both inner and outer members 50, 52 are equipped with a finger controlled ring 27, in order to introduce compressive and tensile forces into the respective handles 12 without the need to grip it. Thus, two adjacent fingers of one hand can simultaneously operate inner and outer members 50, 52 about four axes. It will be appreciated that an additional set of concentrically mounted handles could be disposed parallel to inner and outer members 50, 52 in order to provide control about eight axes with a single hand.

The joystick of the present invention can thus be manufactured economically in a reliable embodiment and as a result of sealing the housing 14 and the sensors 25, the joystick is largely unaffected by environmental influences. In operation, these joysticks are characterized particularly in to their bearing suspension 11 of the handles 12 by an extraordinarily high response sensitivity and by reproducible behavior during the manual application of force into the handle 12. This provides various operational possibilities, for example, one finger could operate the handle 12 by laying it into a groove 32 (FIG. 1, 5 and 6) affixed to the top of handle 12.

What is claimed is:

1. A joystick assembly comprising:

a housing having walls defining an interior;

a handle operatively mounted to said housing for movement relative thereto, said handle includes an upper portion and a lower portion, said upper portion extending outside of said housing interior, said lower portion disposed within said interior of said housing;

an intermediate member operatively affixed to said lower portion of said handle;

a rigid member engaging said intermediate member; and a sensor operatively mounted between said housing and said rigid member, wherein said sensor is adapted to generate an output signal when an input force is applied to said handle, said output signal being proportional to said input force.

2. The joystick assembly of claim 1, wherein said sensor is a piezoelectric pressure transducer.

3. The joystick assembly of claim 1, further comprising an elastic member disposed between and engaging said sensor and said housing.

4. The joystick assembly of claim 1, wherein said intermediate member is spherical.

5. The joystick assembly of claim 1, further comprising a counterweight affixed to said handle.

6. The joystick assembly of claim 1, wherein said handle includes a finger groove in said upper portion of said handle to receive a finger for moving said handle.

7. The joystick assembly of claim 1, wherein said lower portion of said handle is mounted to an elastic block such that said handle can move relative to said housing.

8. The joystick assembly of claim 1, wherein said handle includes a bearing about which said handle pivots about an axis of rotation.

9. A joystick assembly comprising:

a housing having upper and lower portions;

a handle having an outer member concentrically aligned with and surrounding an inner member, said inner and outer members being respectively mounted to said lower and upper portions;

first and second intermediate members respectively affixed to each of said outer and inner members; and first and second sensors respectively mounted to said upper and lower housing portions and in respective contact with said first and second intermediate members, wherein said first sensor is adapted to generate a first output signal when a first input force is applied to said outer member, said second sensor is adapted to generate a second output signal when a second input force is applied to said inner member of said handle, said first and second output signals being respectively proportional to said first and second input forces.

10. The joystick assembly of claim 9, further comprising a counterweight affixed to each of said inner and outer members of said handle.

11. The joystick assembly of claim 9, further comprising first and second elastic members disposed between and respectively engaging said first and second intermediate members and said first and second sensors.

12. The joystick assembly of claim 9, further comprising first and second rigid members disposed between and respectively engaging said intermediate members and said sensors.

13. The joystick assembly of claim 9, wherein each of said inner and outer members further includes a finger ring to receive a finger therein such that said inner and outer members may be independently moved relative to each other by means of two fingers.

14. The joystick assembly of claim 9, wherein said inner and outer members include an arm extending substantially perpendicular to a longitudinal axis of said handle, said intermediate members being respectively coupled to said arms.

15. The joystick assembly of claim 9, further comprising third and fourth sensors respectively mounted to said upper and lower housing portions, wherein said third sensor is adapted to generate a third output signal when said first input force is applied to said outer member, said fourth sensor is adapted to generate a fourth output signal when said second input force is applied to said inner member of said handle, said third and fourth output signals being respectively proportional to said first and second input forces.

16. The joystick assembly of claim 9, wherein said first and second sensors are a piezoelectric pressure transducer.

17. A joystick assembly comprising:

a housing having walls defining an interior;

a handle having a longitudinal axis and upper and lower portions aligned along said longitudinal axis, said upper portion extending out said housing interior, said lower portion being operatively mounted to said housing for movement relative thereto, said handle further including first and second arms extending substantially perpendicular to said longitudinal axis; and first and second sensor assemblies respectively associated with said first and second arms, said first and second sensor assemblies each including in series a spherical intermediate member, a rigid member, and a sensor, each of said intermediate members respectively engaging said first and second arms, and each of said sensors engaging said housing;

wherein each of said sensors is adapted to generate a respective output signal when an input force is applied to said upper portion of said handle, said output signal being proportional to said input force.

18. The joystick assembly of claim 17, further comprising an elastic member disposed between said sensor and said housing.

19. The joystick assembly of claim 17, wherein each of said sensors is a piezoelectric pressure transducer.

20. The joystick assembly of claim 17, wherein said handle includes a finger groove in said upper portion of said handle to receive a finger for moving said handle.

* * * * *